United States Patent [19]

Bray

[11] Patent Number: 4,537,443

[45] Date of Patent: Aug. 27, 1985

[54] PORTABLE OCCASIONAL TABLE AND SEATING

[76] Inventor: Gilbert Bray, 6180 N.W. 7th St., Margate, Fla. 33063

[21] Appl. No.: 539,969

[22] Filed: Oct. 7, 1983

[51] Int. Cl.[3] ..... A47B 3/06

[52] U.S. Cl. ..... 297/159; 108/34

[58] Field of Search ..... 297/157, 159; 108/34, 108/35, 36, 153, 159

[56] References Cited

U.S. PATENT DOCUMENTS

| | | | |
|---|---|---|---|
| 1,351,013 | 8/1920 | Stine | 297/159 |
| 2,548,682 | 4/1951 | Price | 297/159 |
| 2,717,028 | 9/1955 | Villemure | 297/150 |
| 3,731,971 | 5/1973 | Sjogren | 297/151 |

FOREIGN PATENT DOCUMENTS

| | | | |
|---|---|---|---|
| 899826 | 9/1944 | France | 297/159 |

*Primary Examiner*—James T. McCall

*Attorney, Agent, or Firm*—Richard M. Saccocio

[57] ABSTRACT

A portable table with integral seating is disclosed. All of the components of the inventive apparatus fit within a carrying case which also serves as the table top. Unique standoffs and corner braces are pivotally attached to the table top which folds for storage. The table top, bench seats and braced leg assemblies are removably and interlockingly attached to two crossbeams. The bench seats are uniquely attached by pairs of pegs and holes which are at right angles which trap the seats and provide stiffness to the assembly. Folding legs are pivotally attached to braces which when unfolded provide strong cross bracing.

9 Claims, 9 Drawing Figures

PORTABLE OCCASIONAL TABLE AND SEATING

BACKGROUND OF THE INVENTION

1. Field of the Invention

This invention relates in general to the field of occasional chairs and tables and in particular to the field of portable, foldable chairs and tables intended for occasional use.

2. Description of the Prior Art

There is almost always a need for occasional seating and tables which are both portable and foldable. The need includes both indoor and outdoor use. For example, such needs might include additional dining space for extra guests as when a family gathers for holiday festivities; extra table and seating for bridge or other card playing parties; table and seating for camping activities or merely stopping along the roadside for lunch when traveling; balcony or patio use. There are, of course, other such needs for occasional seating and tables.

Card tables having legs which fold against the flat playing surface is one type of an occasional table which is widely accepted and can be found in a large number of households. Folding metal chairs are usually associated with the card tables. As a general rule, the card table's legs are spindly and when extended do not provide suitable stability to the table. A nonacceptable amount of wobble is usually associated with such tables. The instability often increases with age and usage of the table. Metal folding chairs are, on the other hand, quite stable and strong. Their main disadvantage is the bulk or space they occupy even when folded; and, they usually are somewhat heavy. The combined bulk of such chairs and tables also usually creates a storage problem. Four folded chairs and a card table can occupy a substantial amount of space in a normal-to-small size closet.

There is another type of folding table designed for indoor use which comprises relatively long, narrow tables. This type of table is most often utilized in meeting or banquet rooms of hotels, clubhouses, auditoriums, and other such commercial applications. They usually are not found in houses. Since this type of folding table is designed for commercial use, they are relatively stable when erected but suffer form a weight and storage standpoint. Also, the cross braces on the legs virtually eliminates end seating positions, which is another reason such tables are not acceptable for home usage.

The table and seating most often found outdoors comprises the well-known redwood picnic table with integral bench seating. These tables are very heavy, not portable and do not fold for storage or transportation. They are typically found in park, beach or roadside picnic areas and although not fixed to the ground, comprise a permanent installation.

There are a number of portable, foldable chairs available which are designed for outdoor use. One example of this type of chair is the tubular aluminum framed chair having nylon or plastic straps fixed to the seat and back support portions of the chair. While this example of seating is lightweight, they are rather bulky even when folded and thereby create a storage problem. Four chairs of this type would substantially fill the trunk space of a full-sized automobile and would probably not fit in the trunk of many of today's smaller compact automobiles.

Foldable benches are another type of chair designed for outdoor use. This type of chair usually has a pair of hinged legs which take on an "x" shape when unfolded and a canvas seating portion. Even though this type of chair is small and relatively lightweight, they do not fold into a compact shape and thus, also create a storage problem.

Thus, there is still a need for an occasional table and chairs which are adaptable for both indoor and outdoor use, are foldable, are lightweight, are compact when folded, are easily and conveniently folded and erected and yet are strong and stable when erected. Accordingly, such features and advantages are the primary objects of the present invention.

SUMMARY OF THE INVENTION

The present invention overcomes the problems and disadvantages of the prior art by providing a portable foldable occasional table and seating which is lightweight, strong and exceptionally stable, seating four or more adults.

The entire combination fits within a compact hinged carrying case which when open comprises a table top. A unique pivoting standoff is provided at each corner of the table top. A pivoting brace is attached to each standoff which when wedged against a corner of the table top and when the standoffs of the table top are notch seated to two main crossbeams, rigidly secures the table top to the assembled table and integral bench seating. The seating comprising a pair of lightweight elongated bench seats are each fitted to notched ends of the main crossbeams. Thus, each bench seat is removably attached to each of the two crossbeams. Dowel pins at right angles to each other are used in conjunction with each of the notches in the crossbeams to securely attach the bench seats to the assembly and prevent movement in the horizontal, vertical and lateral directions.

A pair of braced leg assemblies, with each assembly containing two legs are also attached to the main cross beams. Each leg assembly comprises two legs and two braces pinned at the ends thereof to each leg. The braces are uniquely offset to each other in the longitudinal direction such that when folded for storage, each leg and each brace are aligned in the longitudinal direction. When unfolded, the braces form an exceptionally rigid "x" structure. Each braced leg assembly is notch fitted to the main crossbeams. Thus, the braced leg assemblies, the bench seats and the table top are each transversely fitted to the two spaced and parallel main crossbeams.

When disassembled and folded for storage, each component part of the combination comprises an elongated structure or beam which conveniently fits within each half of the table-top carrying case and virtually occupies the entire internal space thereof. When the carrying case is closed and latched, a single elongated compact structure results.

Various other objects, advantages and features of the invention will become apparent to those skilled in the art from the following discussion taken in conjunction with the following drawings, in which:

DESCRIPTION OF THE PREFERRED EMBODMENTS

Figure 1:
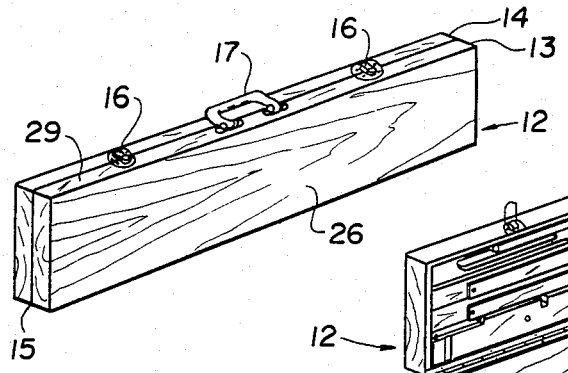
FIG. 1 is a perspective view illustrating the inventive table and integral seating arranged for storage or transport.

Referring now to the drawings, FIG. 1 shows the inventive occasional table and seating 10 in its storage and transportation mode. In this mode, the table top 12 also comprises the container within which all the other components of table and seating 10 are placed when in a completely disassembled mode. In this regard, the table top or container 10 will alternatively be referred to as either the table top or the container depending on its then function. Container 12 comprises two halves 13 and 14 which are joined together by a full length hinge 15. Two conventional clasps 16 are used to secure container 12 in a closed position. A carrying handle 17 is attached to one of the halves 13 or 14 for purposes of carrying the containerized table and seating 10.

Figure 2:
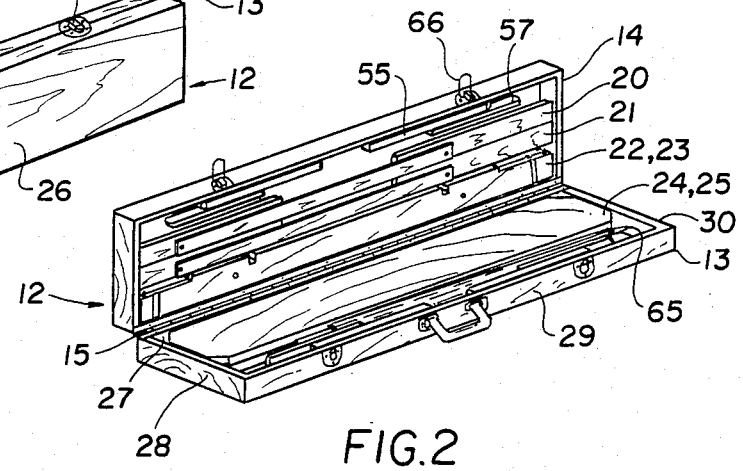
FIG. 2 is a persepective view illustrating the fitting of the various components of the inventive table and seating fitted within the table-top carrying case.

FIG. 2 shows the container 12 in an open position and illustrates the location of the various other components of table and seating 10 within the container or table top 12. One half 14 of the container 12 includes the two braced leg assemblies 20 and 21 and the two main crossbeams 22 and 23. The other half 13 of the hinged container 12 includes the two bench seats 24 and 25. As can be seen, each half 13 and 14 of container 12 includes a flat surface 26 and four raised sides 27, 28, 29 and 30 so as to form an open rectangular container. When each half 13 and 14 is closed, they form the hollow container 12 within which the various components of table and seating 10 are fitted. As previously stated, container 12 also comprises the table top of the inventive table and seating. The outside surfaces of container 12 may be covered with hard plastic sheeting such as FORMICA so as to provide durability, allow for easy cleaning and to provide an aesthetically pleasing appearance.

Figure 3:
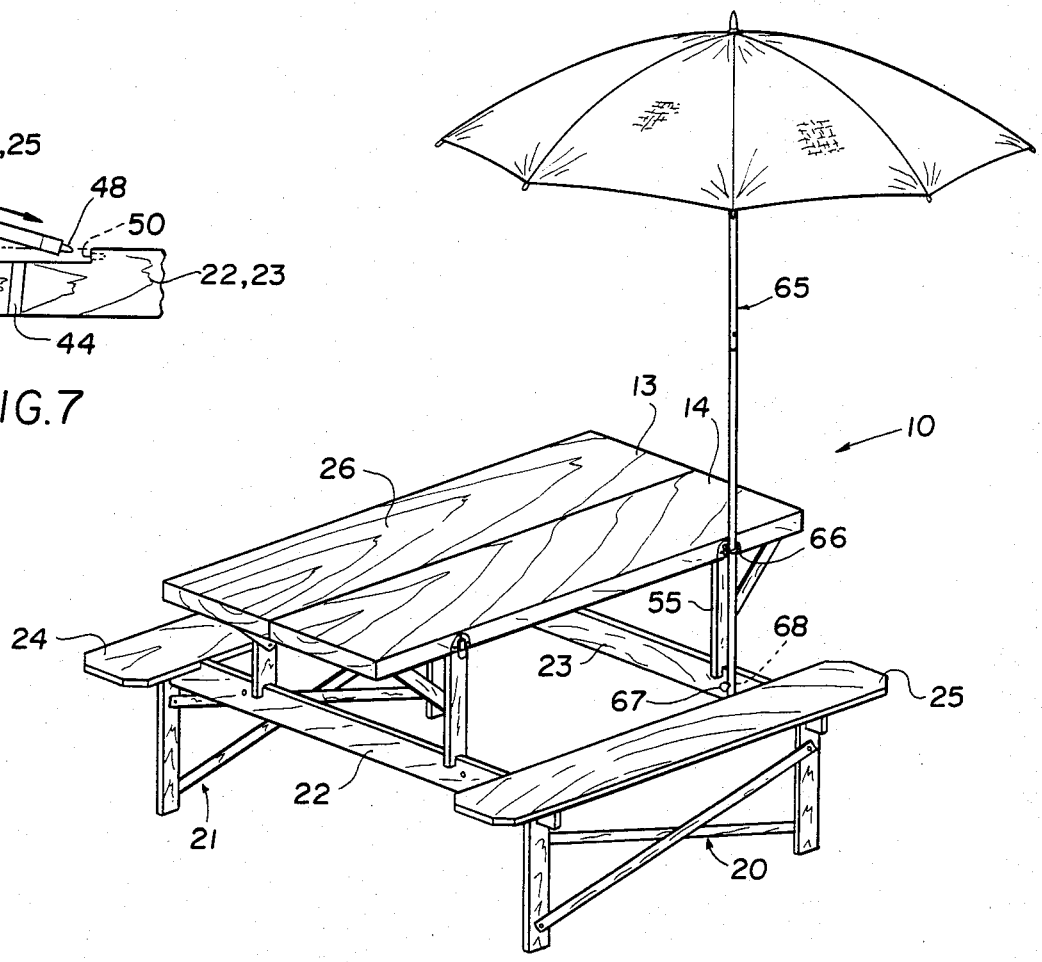
FIG. 3 is a perspective view illustrating the inventive table and seating in a fully assembled mode.

FIG. 3 shows the inventive table and seating fully assembled and ready for use.

Figure 4:
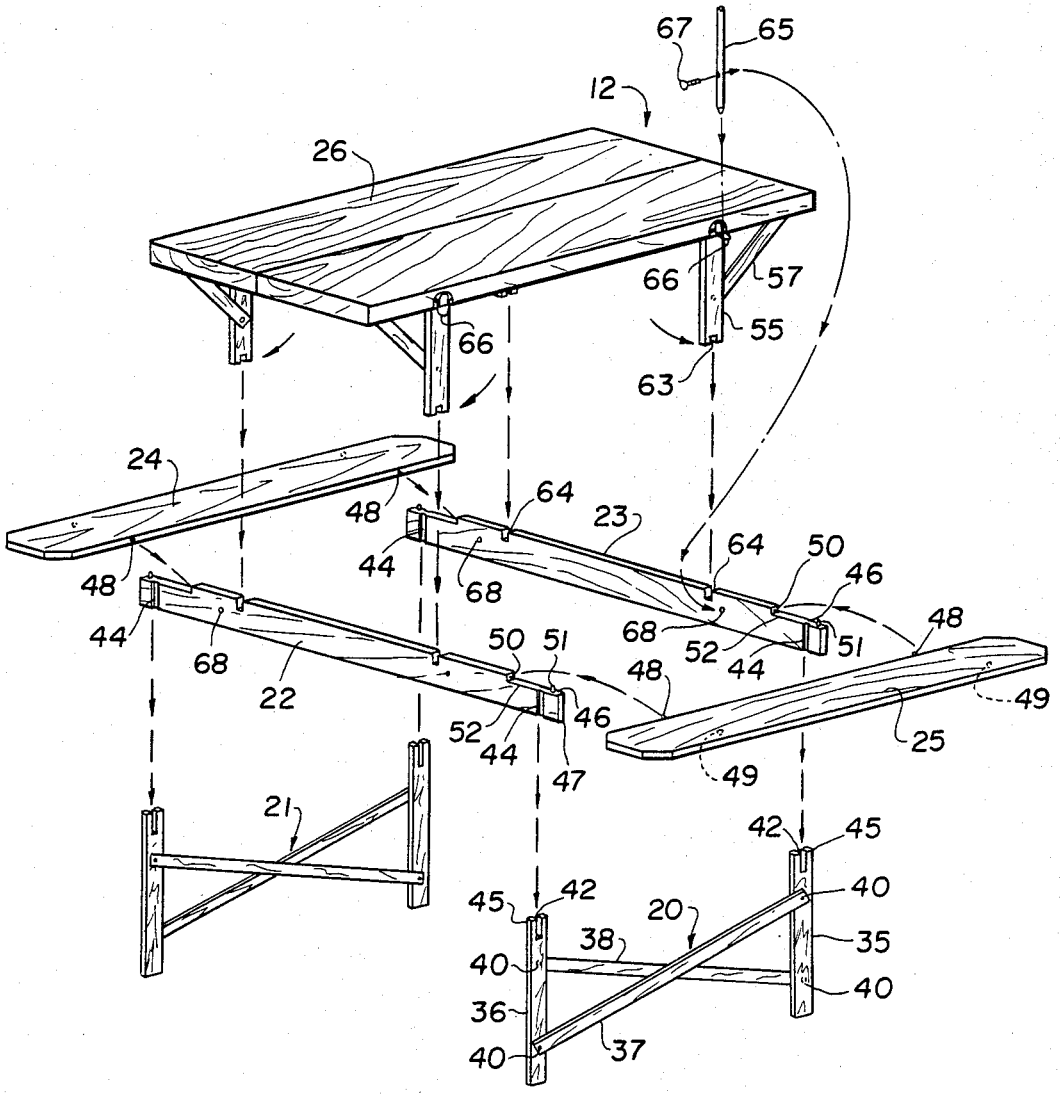
FIG. 4 illustrates the overall manner in which the component parts of the table and seating are arranged with respect to each other.

FIG. 4 illustrates the manner in which the table and seating 10 is assembled as well as the details of the construction of the same.

Upon opening container 12, the individual assemblies or components 20, 21, 22, 23, 24 and 25 may be removed and the table and seating 10 may then be erected.

Braced leg assemblies 20 and 21 are first set up. They each comprise legs 35 and 36 which in turn comprise elongated solid rectangular structures or bars, and braces 37 and 38. Braces 37 and 38 also comprise elongated rectangular bars which may be thinner and less wide than legs 35 and 36. For example, legs 35 and 36 may each comprise $\frac{3}{4}$ inch thick by $2\frac{1}{4}$ inches wide by 17 inches long pieces of wood such as spruce or pine. Braces 37 and 38 may each comprise $\frac{1}{4}$ inch thick plywood, such as fir or birch, $1\frac{1}{2}$ inches wide by $31\frac{1}{2}$ long. It is to be noted that the invention is not to be limited to the above and below described sizes or materials. The given sizes and materials are by way of an example only. A prototype model of the inventive table and seating 10 has, however, been made in accordance with the described example and such prototype has been shown to adequately seat and support four full-sized adults while being small and sufficiently compact as to be conveniently carried, stored and transported.

Figure 5:
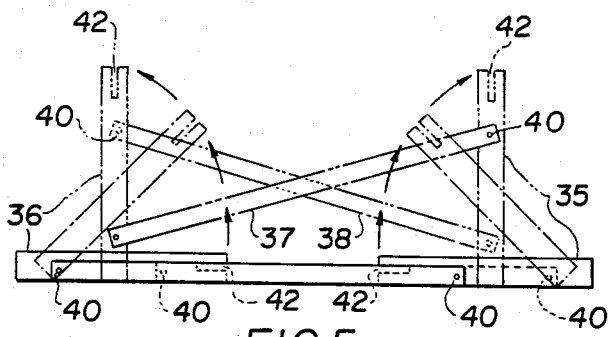
FIG. 5 is a side view illustrating the folded and erected details of the leg and brace assembly.
Figure 6:
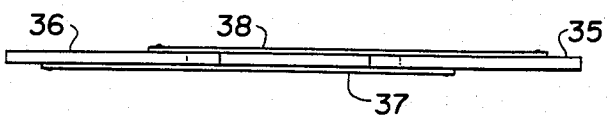
FIG. 6 is a top view of the assembly of FIG. 5.

When folded for shipment or fitting within container 12, the legs 35 and 36 and braces 37 and 38 of each brace assembly 20 and 21 are arranged longitudinally so as to form a substantially straight assembly which is very convenient to store. Each brace, for example, brace 37, is longitudinally offset relative to the other brace 38, as shown more clearly in FIG. 6. The offset is provided such that when legs 35 and 36 are rotated in the direction of the arrows shown in FIG. 5, braces 37 and 38 form an "x" configuration relative to each other. Thus, when legs 35 and 36 are rotated to a vertical position, brace 37 extends from a top portion of leg 35 to a bottom portion of leg 36 while brace 38 extends from a top portion of leg 36 to a bottom portion of leg 35, with each brace 37 and 38 crossing at their midlengths. In order to accomplish the above-described rotation, the approximate end of each brace 37 and 38 is pinned 40 to the appropriate bottom or top portion of the legs 35 and 36. Pinning may be accomplished by a simple wood screw with a plain washer between the leg and the brace connection. The washer provides a reduced friction surface during rotation so that the screw does not loosen. There are, of course, other types of well known pinned joints or techniques that may be used with equal success. FIG. 5 also shows, in phantom, the position of legs 35 and 36 relative to braces 37 and 38 when legs 35 and 36 are rotated in the direction of the arrows. The position shown in phantom is, of course, the position of braced leg assemblies 20 and 21 as they are to be assembled to table and seating 10.

The table and seating assembly operation continues with the attachment of main crossbeams 22 and 23 to braced leg assemblies 20 and 21. This is accomplished by holding one brace assembly either 20 or 21 in a vertical position and positioning one main crossbeam either 22 or 23 at a right angle to the selected leg brace assembly either 20 or 21 and fitting the slot or cut-a-way portion 42 of one leg of the leg brace assembly to the grooves 44 provided on each side of the main crossbeams 22 and 23. When each of the crossbeams 22 and 23 are thus connected to each leg brace assembly 20 and 21, the substructure of the table and seating 10 is assembled. A self standing boxlike substructure results. The main crossbeams are fully inserted in slots 42 of the legs 35 and 36 of each leg brace assembly 20 and 21 such that the top edge 45 of the legs 35 and 36 are substantially level or in the same plane and at right angles to surface 46 of the main crossbeams 22 and 23. The grooves 44 in crossbeams 22 and 23 are slightly angled from the bottom surface 47 thereof toward table top 12 for purposes of angling each leg brace assembly 20 and 21 divergingly inward toward an imaginary apex above table top 12. Such leg angling is well known in the art and may be seen on substantially every permanent picnic table. Preferably, the width of grooves 44 should be substantially the same thickness of legs 35 and 36 and the thickness of the tendon between the grooves 44 should be substantially the same size of the slot 42 in legs 35 and 36 so that a slight friction fit results at the joint when assembled. Consistent with the sizes stated above, main crossbeams 22 and 23 may be $\frac{3}{4}$ inch thick by $3\frac{1}{2}$ inches wide by $45\frac{1}{2}$ inches long and may be made from wood such as spruce or pine.

Figure 7:
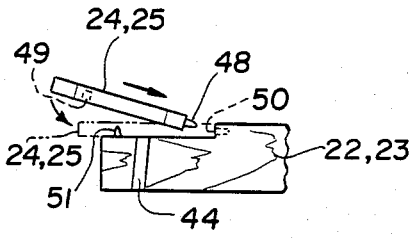
FIG. 7 is a side partial view illustrating the details of assembly of the bench seating to the main braces of the inventive table and seating.

Either table top 12 or seats 24 and 25 may next be assembled to the completed substructure comprising the two braced leg assemblies 35 and 36 and crossbeams 22 and 23. Assuming that the seats are to be next assembled to the substructure, seats 24 and 25 are removed from container 12. Seats 24 and 25 each comprise elongated boards which may be made from wood $\frac{3}{4}$ inch thick by 7 inches wide by $45\frac{1}{2}$ inches long. Again, spruce, pine or other similar wood may be used. Each seat 24 and 25 is provided with a pair of pegs or dowels 48 and a pair of holes 49, with one peg 48 and one hole 49 being aligned therewith across the width of seats 24 and 25, and spaced from the other peg 48 and hole 49 by the spacing between the crossbeams 22 and 23. In this manner each seat 24 and 25 will exactly fit with corresponding holes 50 and pegs 51 provided at the notched ends 52 of crossbeams 22 and 23. It is to be noted that each peg 48 and its corresponding hole 49 on seats 24 and 25 are axially aligned at right angles to each other. And, similarly, each peg 51 and its associated hole 50 at the notch 52 of each end of each crossbeam 24 and 25 are also axially aligned at right angles to each other. Pegs 51 are intended to fit into holes 49; while pegs 48 are intended to fit into holes 50. The diametrical size of holes 49 and 50 are substantially the same diametrical size of pegs 48 and 51 so as to obtain a slight force fit when the pegs are fitted within their respective holes. In order to attach seats 24 and 25 to crossbeams 22 and 23 and because of the right angle alignment of the pegs and holes 48, 51 and 49 and 50, it is necessary to angle seats 24 and 25 as shown in FIG. 7 and partially fit pegs 48 into holes 50, then to rotate seats 24 and 25 downward in the direction of the arrow to partially engage pegs 51 with holes 49. Then, with both sets of pegs and holes partially engaged, seats 24 and 25 are pushed further downward (again in the direction of the arrow in FIG. 7) and simultaneously inward (toward the direction of table top 12) to fully engage pegs 48 with holes 50 and pegs 51 with holes 49. In order to accomplish such partial and final engagement, the tips of pegs 48 and 51 may be tapered; or, conversely, the entrances to holes 49 and 50 may be countersunk. When seats 24 and 25 are assembled to crossbeams 22 and 23, these are, thus, locked in position and will not slide or move in any direction during normal usage. Seats 24 and 25 are, of course, directly supported by the coplanar surfaces 45 of legs 35 and 36 and 46 of the notches 52 of cross-beams 24 and 25. Because seats 24 and 25 are locked in position to crossbeams 22 and 23, they too provide stability to the substructure now comprising braced leg assemblies 20 and 21, crossbeams 22 and 23, and seats 24 and 25.

Figure 9:
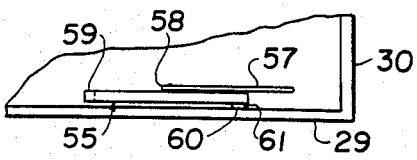

The final component necessary to complete the assembly of table and seating 10 is the table top 12. At this point of the sequence of assembly, the function of the table top 12 is no longer that of a container; it now functions only as a table top. With table top 12 completely open such that each of the two halves 13 and 14 are coplanar and with the flat surface 26 down, standoffs 55 are exposed at each corner of table top 12. FIG. 9 shows one such standoff 55 as it lays flat within and against raised edges 27. Standoffs 55 each comprise an elongated bar which is pivotally attached at end 56 to sides 27. Another elongated bar, which comprises a corner brace 57, is pivotally attached at end 58 to the approximate midpoint of standoff 55. In the unassembled position, both standoff 55 and corner brace 57 are located side by side extending in the same longitudinal direction and parallel with edge 27. The width of standoff 55 and corner brace 57 are substantially the same as the inside height of edge 27 so that neither standoffs 55 nor braces 57 interfere with the closure of container 12. It is also to be noted that standoffs 55 and corner braces 57 occupy very little space in container 12 and only in one longitudinal direction (along edge 27) when container 12 is closed. Both standoffs 55 and corner braces 57 may be made from wood with standoffs 55 measuring $\frac{3}{4}$ inch thick by $1\frac{1}{2}$ inches wide by $12\frac{1}{2}$ inches long and with corner braces 57 measuring $\frac{1}{4}$ inch thick by $1\frac{1}{4}$ inch wide by $10\frac{1}{2}$ inches long.

Figure 8:
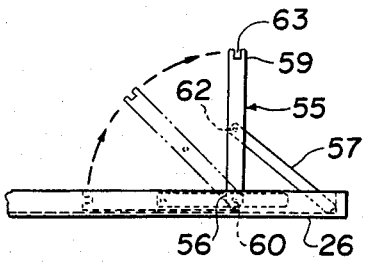
FIG. 8 is a side partial view illustrating the folded and erected details of the table top standoffs; and, FIG. 9 is a top partial view of the standoff and brace assembly of FIG. 8.

In order to erect standoffs 55, end 59 is pivotally rotated away from the inside of surface 26 and in the direction of the arrow in FIG. 8. Pivot pin 60 at end 56 of standoffs 55 allow such rotation. For simplicity, pivot pin 60 may comprise a wood screw and to prevent unscrewing of the wood screw during rotation of standoffs 55 a washer 61 may be used between the adjacent surfaces of standoffs 55 and edge. While standoff 55 is being rotated to an erect position, corner brace 57 will, in most instances, automatically position itself against edge 30 to the bracing position shown in FIG. 8. In those instances where brace 57 does not automatically position itself, its position may be fixed by hand and as allowed by pivot pin 62. When all standoffs 55 are erected and corner braces 57 are in position against edge 30, table top 12 may be assembled to the previous substructure. This is accomplished by fitting slots 63 of standoffs 55 to the corresponding slots 64 pivoted in crossbeams 22 and 23.

An umbrella 65 may be attached to any of the four side corners of side 27 of table top 12. One such positioning of umbrella 65 is shown in FIG. 3. The shaft of umbrella 65 is slidingly received in "D" ring 66 attached to side 27. The "D" ring may comprise the ring provided with clasps 16 or may be a separate ring. The end of umbrella 65 is secured by a thumbscrew 68 which fits within a hole in the umbrella shaft and is screwed into a T nut fixed to the side of crossbeams 22 and 23. The inventive table and seating 10 is now fully assembled and ready for use. Umbrella 65 may alternatively include a clamp at its lower end (not shown) which is well known in the art and can be clamped to table top 12 at any desirable location.

Disassembly of the table and seating may be accomplished by using a procedure opposite to that above described.

It is to be noted that crossbeams 22 and 23 have been designated in this specification as crossbeams. However, as used in the inventive table and seating such beams comprise support beams which do not cross each other but are rather spaced and parallel to each other and cross at right angles to the major axis of the bench seats 24 and 25, the table top 12 and the braced leg assemblies 20 and 21. The designation crossbeams, therefore, refers to the right angle orientation relative to the other main assemblies of the table and seating 10. Hence, crossbeams 22 and 23 may alternatively be designated as support beams. On the other hand, the braces 37 and 38 when assembled to the table and seating actually cross each other.

While the invention has been described, disclosed illustrated and shown in certain terms or certain embodiments or modifications which is has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim:

1. A portable table and seating comprising a pair of parallel spaced support beams, a pair of bench seats each being removably attached to opposite ends of said support beams, a pair of braced leg assemblies each being removably attached to opposite ends of said support beams, a table top and means attached to said table top for removably connecting said table top to said support beams, and means for cross bracing each of said pairs of leg assemblies and for folding the legs of each of said pairs of leg assemblies into a substantially collinear position.

2. The apparatus of claim 1, wherein said cross bracing and folding means comprises two braces, with a first brace, comprising an elongated bar, pivotally attached to a first upper side of a first of said legs and to a first lower side of the second of said legs and with a second brace, comprising an elongated bar, pivotally attached to a second upper and opposite side of said second leg and to a second lower and opposite side of said first leg.

3. The apparatus of claim 1, wherein each bench seat attachment to said support beams comprises a first peg and hole combination and a second peg and hole combination at right angles to said first peg and hole combination at each location of the attachment of the bench seat to the support beams.

4. The apparatus of claim 3, wherein each of said two combinations of pegs and holes include a first peg on a vertical edge of said bench seat with a first hole in a vertical surface of a notched cutout in a corner of said support beams and with a second hole in the flat horizontal surface of said bench seat and a second peg in the horizontal surface of said notch in said beams.

5. The apparatus of claim 1, wherein means for pivotally and removably connecting said table top to said support beams comprises four standoff and brace assemblies with said table top being rectangular and each standoff and brace assembly being located at an approximate corner of said table top and comprising a standoff comprising a first elongated bar pivotally attached at one end to said table top and a brace comprising a second elongated bar pivotally attached at an end thereof to the said standoff at the approximate midpoint thereof whereby when erected said standoffs extend down from said table top and said braces extend from the midpoint of said standoffs at an angle up towards said table top with the other end of said braces being wedged against a vertical edge of said table top and extending down therefrom.

6. The apparatus of claim 1, wherein said table top is rectangular in shape comprising two halves attached at one end by a hinge with each half having four raised edges around the periphery thereof whereby when one half is closed upon the other half, the table top comprises a container.

7. The apparatus of claim 6, wherein said bench seats, said support beams and said braced leg assemblies are disconnected from each other and fitted within said container.

8. The apparatus of claim 5, wherein said standoff attachments to said support beams comprises notched joints.

9. The apparatus of claim 2, wherein said leg attachments to said support beams comprises a notch and groove joint.

* * * * *